US005704671A

United States Patent [19]

van der Wal et al.

[11] Patent Number: 5,704,671

[45] Date of Patent: Jan. 6, 1998

[54] BEVERAGE CONTAINER HOLDER AND BLANK THEREFOR

[76] Inventors: Saskia J. van der Wal; Jurjen van der Wal, both of 325 Holmwood Dr., Newport Beach, Calif. 92663

[21] Appl. No.: 677,640

[22] Filed: Jul. 8, 1996

Related U.S. Application Data

[60] Provisional application No. 60/000,868, Jul. 11, 1995.

[51] Int. Cl.[6] ..... B65D 23/10

[52] U.S. Cl. ..... 294/31.2; 220/738

[58] Field of Search ..... 294/27.1, 31.2, 294/32, 33, 87.2, 137, 145, 159; 220/737, 738, 741, 742, 759; 215/396

[56] References Cited

U.S. PATENT DOCUMENTS

| | | | |
|---|---|---|---|
| 1,808,763 | 6/1931 | Burdett | 220/737 |
| 1,910,168 | 5/1933 | Jacobs | 220/737 |
| 2,965,281 | 12/1960 | Herrmann | 294/31.2 |
| 3,142,425 | 7/1964 | Cobb | 294/31.2 |
| 4,196,807 | 4/1980 | Brom | 294/87.2 |
| 4,582,215 | 4/1986 | Barrash | 294/31.2 |
| 4,799,723 | 1/1989 | Mahaffy . | |
| 4,917,428 | 4/1990 | Sola . | |
| 4,998,764 | 3/1991 | O'Connell et al. . | |
| 5,267,644 | 12/1993 | Tsao . | |

*Primary Examiner*—Dean Kramer
*Attorney, Agent, or Firm*—James G. O'Neill

[57] ABSTRACT

A cardboard or plastic blank having an elongated main body, an enlarged head portion, an elliptical opening formed in the enlarged head portion and a pair of elongated wing portions, connected to the main body, adjacent the elliptical opening. The elongated wing portions include outer securing elements that allow the wings to be secured together while the main body is folded to form a beverage container holder.

18 Claims, 4 Drawing Sheets

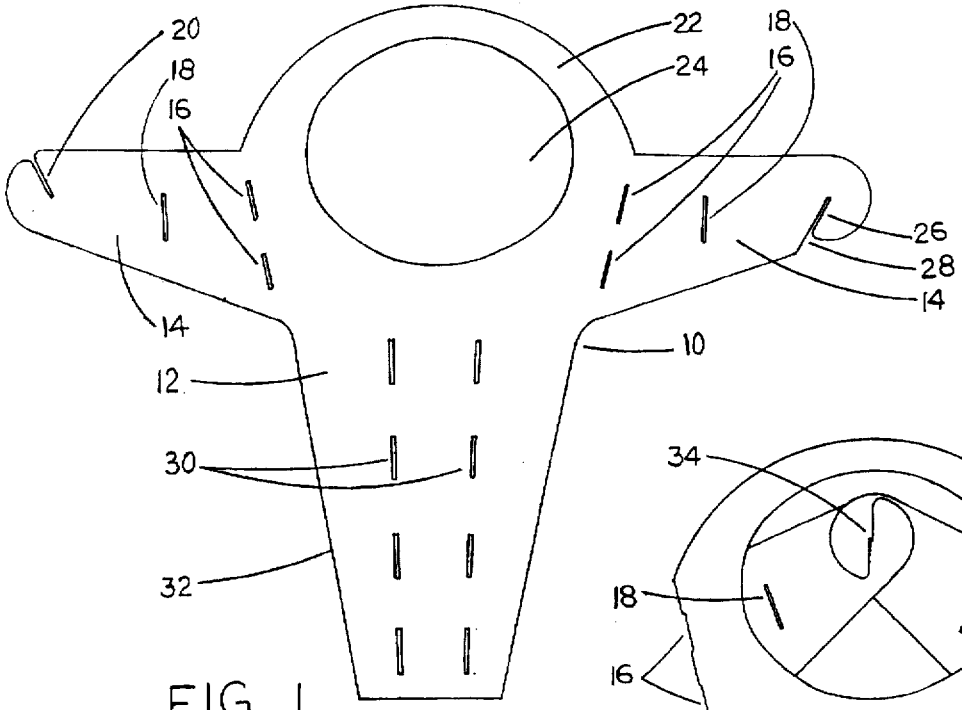
FIG. 1
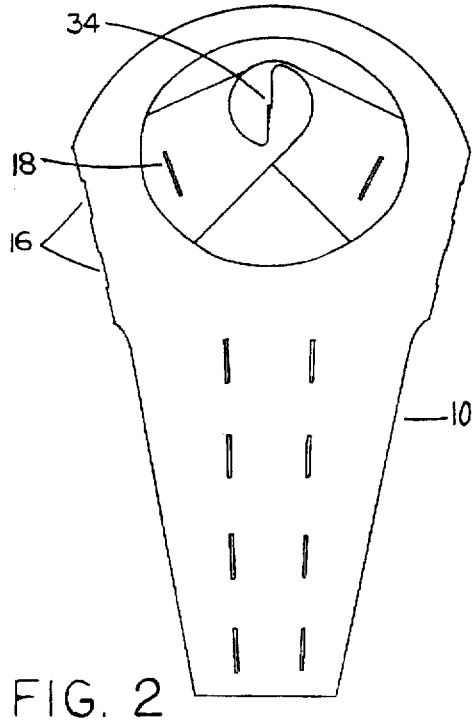
FIG. 2
FIG. 3
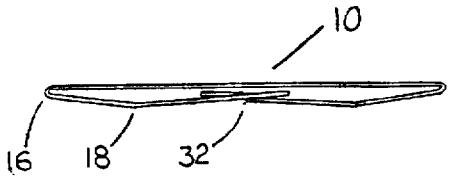

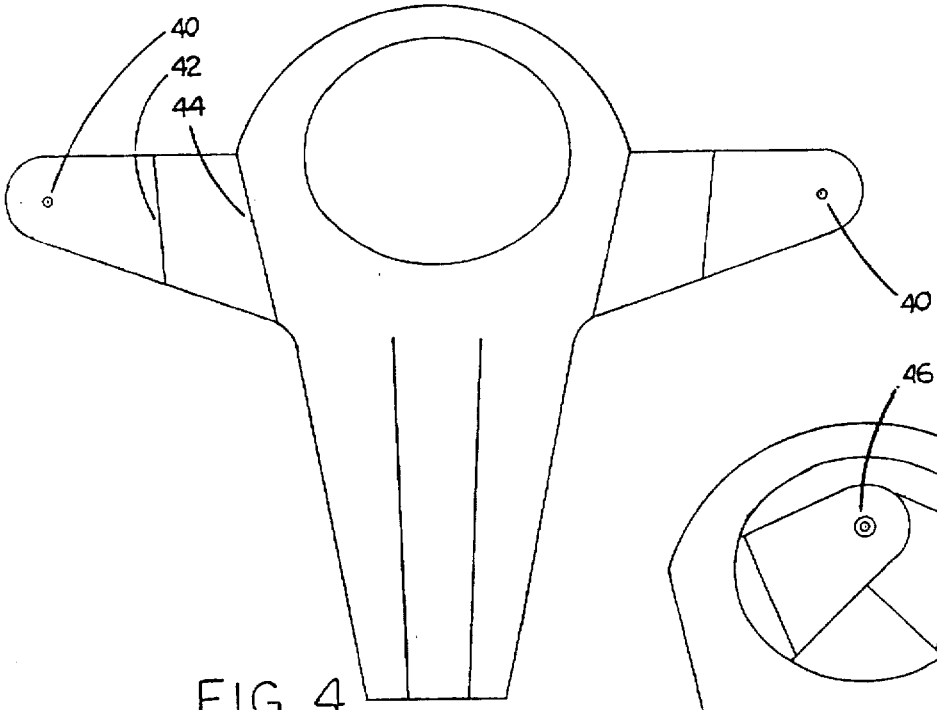
FIG. 4
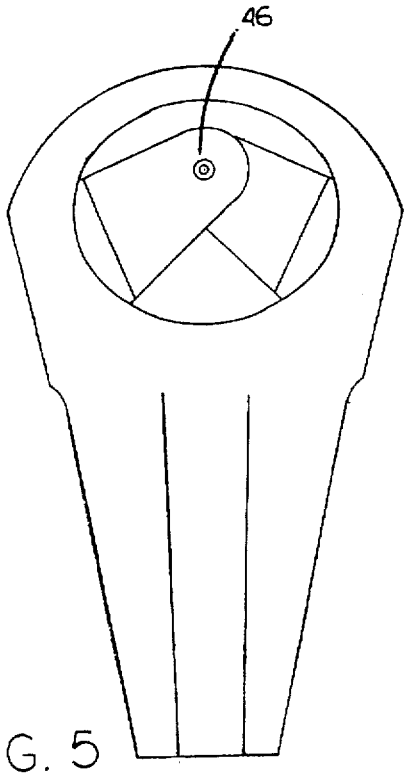
FIG. 5
FIG. 6
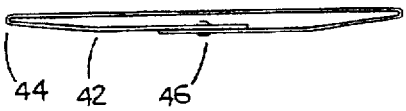

BEVERAGE CONTAINER HOLDER AND BLANK THEREFOR

BACKGROUND OF THE INVENTION

This application claims the benefit of U.S. Provisional Application No. 60/000,868 filed on Jul. 11, 1995.

1. Field of the Invention

This invention relates generally to holding devices, and more particularly, to a beverage container holder.

2. Description of Related Art

In most situations when a person is traveling, the person's hands are holding the carrying handle of a purse, a suitcase or the like. Therefore, when both hands of such a person are completely occupied with carrying their personal belongings, then there is no way that such a person can, in addition thereto, simultaneously carry a beverage container, such as a cup of coffee, a soft drink can, or the like. When a person does carry such a beverage container in one hand and their luggage in the other hand, it becomes extremely difficult to do simple tasks such as open doors. It is our observation and experience that this person then asks for or is given assistance by a companion, stranger, or when he has to do it by himself, he uses his backside, or hip, or his foot, to open and/or close a door. If the door has a handle, then the person will need to put down the suitcase while continuing to hold the beverage container and then open the door, hold the door somehow while picking up the suitcase, and then again move onward.

In order to improve such a person's plight, we have designed and successfully constructed a beverage container carrying device that has a carrying handle that will snugly fit around the handle of the suitcase that the person is already carrying, so that one hand can conveniently carry the suitcase and the beverage container simultaneously, thus freeing the other hand to open doors, use the telephone, etc.

Extensive research in the United States patent files indicate that there is no evidence of a carrying device that will hold a single beverage container such as a coffee cup, a standard beverage can, or another beverage container. Presently a person must use one of his hands to carry a drink, and there do not appear to be any gadgets or mechanisms to carry such a beverage container. Prior art devices consist of beverage container carrying devices that will never hold one, but always two or more containers.

The present invention aims to alleviate many difficulties that arise out of having no free hand available to open doors, etc, particularly where one hand is occupied with carrying a purse, a suitcase, and/or other parcels, and the other hand carries a beverage container. The present invention consists of a carrying handle that can hold a beverage container and whereby this handle can be gripped and held by the same hand that holds the handle of another item, such as a suitcase and/or a purse.

No prior art relating to devices for hand carrying a single beverage container could be found. However, the following references relate to carrying devices for two (2) or more beverage containers.

John W. Mahaffy, U.S. Pat. No. 4, 799,723 is a device that is suitable for carrying two open cups or containers, and it is made from one flat sheet of plastic material. The carrying handle is traversely located midway between the two cup holder openings.

Manuel M. Sola, U.S. Pat. No. 4,917,428 describes a bottle carrying handle including a substantially irregular elongated body which has a tubular-shape configuration at its middle part, the body having at least two ends, each end defining a hook carrying portion formed by a planar surface which is cut in a "U" shape configuration. The cut forms two supporting legs, and each leg includes a bottle neck retainer.

Chuing-Piao Tsao, U.S. Pat. No. 5,267,644 pertains to a tuckable carrier that includes a paper or plastic board having a plurality of container holes formed in a central base plate portion, a pair of side-wing plate portions respectively protruding sidewardly from the central base portion, and a pair of handle portions respectively formed on two outer end portions of the two side-wing plate portions adapted to be held by a user's hand, in which a plurality of portable liquid containers may be carried.

SUMMARY OF THE INVENTION

It is, therefore, a general object of the present invention to provide a beverage container holder for a single beverage container.

The present invention consists of a single beverage container holder with an attached handle that is made from a single piece of cardboard or plastic that may be die cut out of a flat sheet and which includes a large elliptical or oval opening and a number of slits and/or cuts and/or creases in the die cut product or blank so that this blank may be easily folded into the desired shape. This desired shape is obtained when two equal but opposite wing shaped arms or ends are bent towards one another and then hooked together by slots formed in the tips of the cardboard or plastic opposite ends so that a somewhat circular looped closure is created. When formed, this circular looped closure automatically changes the large oval opening in the blank to an opening with a nearly circular horizontal projection so as to match the circular horizontal cross section of a beverage container that may be placed in it. When the bottom of the beverage container is pushed down through this opening, the center of the bottom of this container will come to rest near, or on the connecting points of the earlier described equal but opposite arms that closed the loop. As an integral part of this formation of the just described loop, an extension of this beverage container holder has now become a carrying handle that has a cross section that is substantially an inverted or an upside down "U", whereby the handle has the shape of a slightly tapered half of an inverted or upside down channel that is suitable for placement on top of the handle of a suitcase and/or a purse in such a manner that the handle extension of this beverage container holder will rest its concave curvature on the upper convex shaped portion of the handle which it covers, so that a person gripping the suitcase handle will also simultaneously firmly press the handle of the beverage container holder against the top of the handle so that both may be easily and conveniently carried by one hand.

Of special note is the fact that the folded and interlocked opposite tips of the arms or wings that form the bottom support for the beverage container have the added feature that the central joining point of this interlock has become a moveable pivot point between the two opposite interlocked ends of the original flat sheet, whereby this central pivot point permits a limited amount of pivoting between those opposite ends when the thumb and index finger of the hand of the person who carries this device squeezes the handle, as needed, to decrease the width of the oval opening to make a more or less circular shape, which will have the effect of squeezing or more firmly gripping the round outside of the beverage container. This feature of being able to adjust the size of the opening to the size of a variety of different beverage containers with different tapers is a very important feature of this invention. In fact, this squeezing is so effective that a standard cylindrical twelve ounce unopened soda can may be put into this container carrier, squeezed, and held upside down without falling out.

In a preferred embodiment of the invention, the oval opening in the cardboard as it comes out of the stamping press should have a long axis of approximately 3 inches and a short axis of approximately 2.625 inches. The standard 12 ounce soft drink aluminum can in the U.S.A. has an outside diameter of exactly 2.60 inches, and it fits snugly in the oval opening when the tips of the arms or wings have been locked onto one another, which results in the oval opening approaching a nearly circular cross section. After much experimentation it was also found that the thickness of cardboard used to make the device should not be less than 30 mils (0.030" or 0.75 mm.), because a lesser thickness cannot supply the strength and stiffness that is needed for this device when it carries a full drinking cup or can. The preferred 30 mil cardboard used is referred to in the trade as chipboard or solid unbleached sulfate.

Since standard aluminum soft drink cans always have a cylindrical shape, with a 2.6" diameter, the short axis of 2.625" of the oval opening is obviously adequate to accommodate all of such aluminum cans, as well as the large majority of all tapered cups that are use for soft drinks, coffee or tea.

Another important feature of this carrying handle for beverage containers is the fact that its closed loop configuration may be pushed flat whereby the interlocking opposite ends remain joined as they fold down and come to rest within the opening that will hold the beverage container. This collapsing feature provides for easy packaging, shipping, and handling of a completely assembled and ready to use beverage container carrier which now can be handed out in this flat shape to the end user, who will not have to spend time and effort to assemble this product for its proper end use, because all that has to be done is to push down through the beverage container carrier opening and it is then ready for its intended use.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, wherein like reference numerals are used throughout the several views, and, in which:

FIG. 1 shows the preferred shape of a first embodiment of the carrying handle, having fold lines thereon, as it comes out of a stamping press, and before it is folded.

FIG. 2 is a top plan view of the carrying handle of FIG. 1, after the two opposite arms or wings have been folded towards each other and their hooking slots interlocked.

FIG. 3 is a front elevational view of the folded carrying handle of FIG. 2.

FIG. 4 is a further embodiment of the carrying handle that has creases formed on the places where it has to fold as it comes out of a stamping press.

FIG. 5 is a top plan view of the carrying handle of FIG. 4, after the two opposite arms or wings have been folded towards each other, and united by a rivet, by gluing, or the like.

FIG. 6 is a front elevational view of the folded carrying handle of FIG. 5.

DESCRIPTION OF THE PREFERRED EMBODIMENTS

Figure 7:
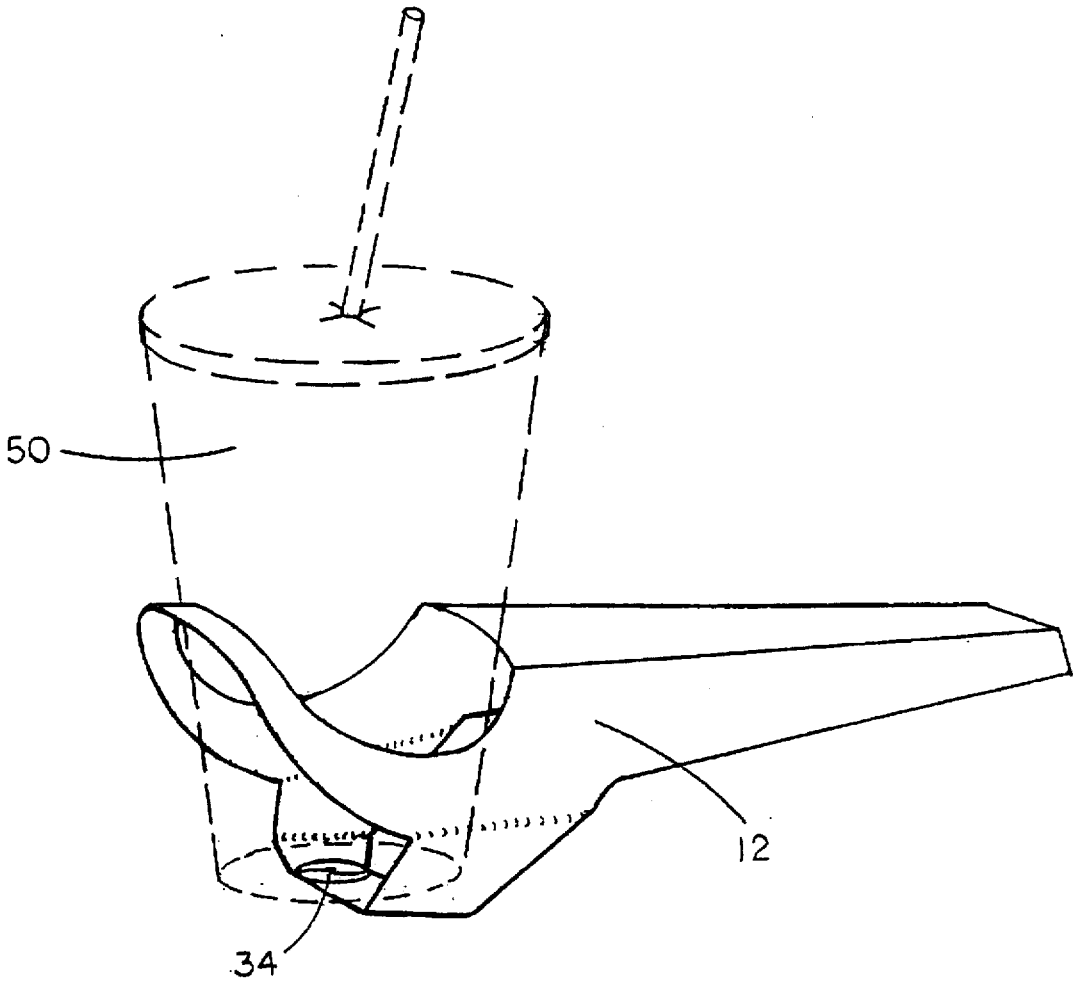
FIG. 7 is a perspective view of the carrying handle of FIG. 1, with a soft drink cup placed in the opening and supported by the secured together ends of the arms.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to describe a novel beverage container holder.

Referring to FIG. 1, it is noted that this invention is preferably made from a single piece of cardboard or plastic that has been stamped out and is in a flat configuration. A beverage container holder 10 has a main body 12 that will become the handle portion, as explained more fully below, and two arms or wings 14. The arms or wings 14 may be folded towards each other. The folding occurs along fold lines, and is facilitated by crease means 16, 18 such as cuts or slits. As shown at 16 and 18, there are two separate fold lines formed by the crease means on each arm 14. One of the folds of each arm 14, namely 16, is adjacent an enlarged head portion of the holder 10.

One of the arms or wings 14 has a slit 20 that is cut at a predetermined angle near its tip. The angled slit 20 is designed to engage with a further angled slit 26 that is formed near a tip of the opposite arm or wing. Indentation 28 facilitates the locking together of the wings.

The wings meet and lock together under an elliptical or oval opening 24 that is partly surrounded by a flat cardboard curve 22.

Two rows of creases or slits 30 along fold lines in the handle portion permit lengthwise partial folding of up to 90 degrees, to enable the handle to be bent into the shape of an inverted or upside down "U". The handle has tapered side edges 32, to enable the little finger of a user's hand to grip the handle at the narrowest end of the taper and the larger thumb and index finger of the user to grip the handle at the widest end of the taper, so that the thumb and index finger are against the folded arms or wings 14 that are below the oval opening. The advantage of this arrangement is that the thumb and index finger of the user can squeeze the opposing arms or wings towards each other, resulting in the oval opening getting smaller to the point that the edge of the oval opening will press fairly hard against the side of a drinking can or cup, held in the opening 24.

FIG. 2 shows that it is possible, with the use of the preplanned folds, to press the present invention flat, which has the advantage that a minimum of space is occupied when many such devices are shipped in a package.

The squeezing of the wings by the thumb and index finger of a user causes their central point of interaction 34 to become a pivot point for the relative movement of the wings with respect to one another.

As shown in FIG. 3, the tips of the two wings are inserted so as to be above the body of their opposing wing in their locked position. This makes for a much better cup support than if the wing tips were below their opposite wings.

FIGS. 4, 5 and 6 are nearly identical to FIGS. 1, 2 and 3, with the exception that they contain crease means 42 and 44, forming fold lines. Furthermore, pivot point 34 of FIG. 2 has been replaced by holes 40 and a rivet or other securing means 46 is inserted to secure the ends, or the ends may be glued, and serve as a pivot point.

FIG. 7 provides a general perspective view of the relationship between the beverage container holder and a beverage container 50 held in opening 24. In its operational configuration the interconnecting pivot point 34 is very nearly positioned under the center of the beverage container.

Figure 8:
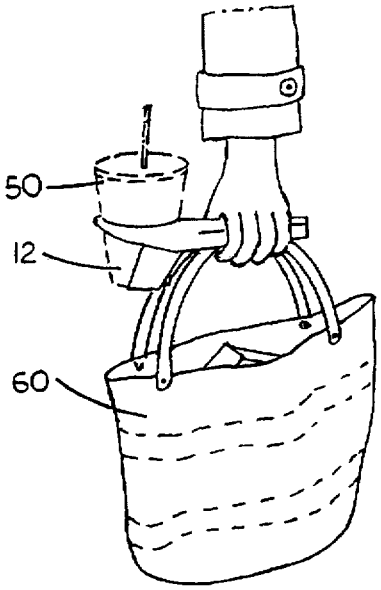
FIG. 8 is a further perspective view indicating how the carrying handle is held by a user with the two handles of a purse under it.

As was intended, the shape of the inverted or upside down "U" will fit nicely over one or two purse handles, as shown in FIG. 8, with the hand of a user firmly holding on to this snugly fitting assembly.

Figure 9:
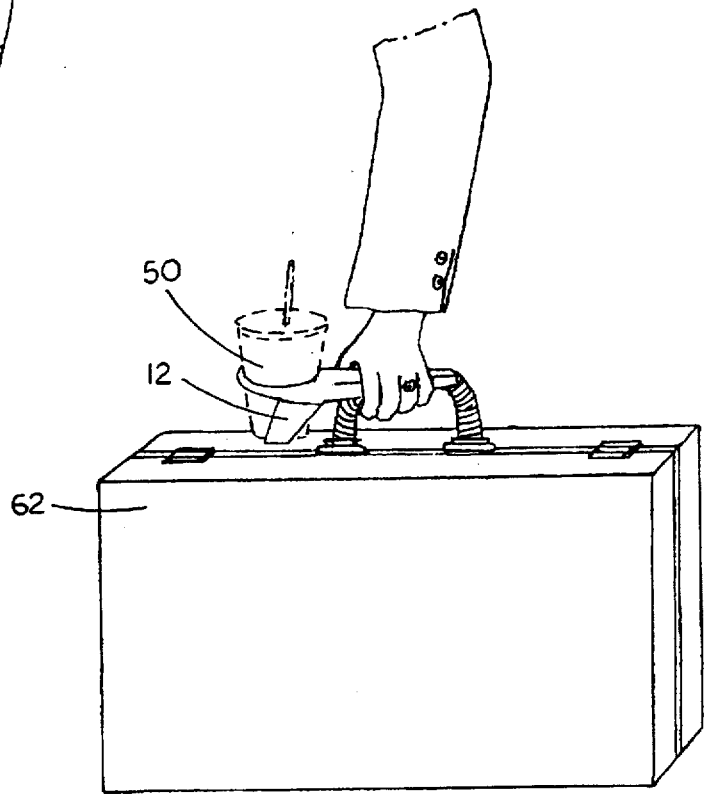
FIG. 9 is a still further perspective view showing the carrying handle held by a user on top of the handle of a suitcase.

A business person is shown in FIG. 9 conveniently placing the beverage container holder over a handle of a suitcase 62, leaving the person's other hand free to open doors, to write a note, or the like.

What is claimed is:

1. A blank for forming a beverage container holder, comprising, in combination:

a substantially flat elongated body including a handle portion;

an enlarged head portion secured to said handle portion;

an opening formed through said enlarged head portion;

a pair of elongated wing portions secured to said enlarged head portion on opposite sides of said opening;

a plurality of crease means formed in said handle portion and said pair of elongated wing portions, to form fold lines along which said wing portions and said handle portion may be folded; and each of said pair of elongated wing portions having a tip with an angled slit formed therein, whereby said pair of elongated wing portions may be joined together by the joining of the angled slits when said wing portions are bent toward each other.

2. The blank of claim 1 wherein said handle portion includes tapered sides, which tapered sides taper inwardly toward each other, as they extend outwardly, away from said enlarged head portion.

3. The blank of claim 2 wherein said pair of elongated wing portions include tapered edges, which tapered edges taper inwardly toward each other, as they extend outwardly toward the tips thereof, away from said enlarged head portion.

4. The blank of claim 3 wherein each of said pair of elongated wing portions has two fold lines formed therein.

5. The blank of claim 4 wherein said handle portion has a pair of fold lines formed therein, and said opening formed in said enlarged head portion is elliptical.

6. A beverage container holder for holding a beverage container, comprising in combination:

a body having an enlarged head portion secured to an elongated handle portion;

an opening formed in said enlarged head portion through which a beverage container may be inserted and held in said beverage container holder; and a pair of wing portions secured to said enlarged head portion; said pair of wing portions being bent toward each other and having tips which are secured together so as to form a support means for a beverage container inserted in said opening.

7. The beverage container holder of claim 6 wherein said opening is elliptical.

8. The beverage container holder of claim 7, further including a plurality of crease means formed in said elongated handle portion and said pair of wing portions; said plurality of crease means forming a plurality of fold lines along which said elongated handle portion and said pair of wing portions may be folded.

9. The beverage container holder of claim 8 wherein said elongated handle portion tapers inwardly toward a centerline of said elongated handle portion as said elongated handle portion extends outwardly, away from said enlarged head portion.

10. The beverage container holder of claim 8 wherein each of said pair of wing portions includes an outer tip, away from said enlarged head portion, and a slit is formed in each of said pair of wing portions, adjacent said tip, whereby said wing portions may be folded and secured together by inserting the respective slits into each other.

11. The beverage container holder of claim 10 wherein each of the slits formed in said pair of wing portions is formed at an angle to its respective wing portion.

12. The beverage container holder of claim 6 wherein each of said pair of wing portions includes an outer tip, and securing means secure the outer tips of said pair of wings portions together.

13. The beverage container holder of claim 12 wherein said securing means is an angled slit formed in each of said pair of wing portions, adjacent to the respective tip thereof, and the angled slit of each of said pair of wing portions is inserted into the angled slit of the other.

14. The beverage container holder of claim 13, further including a plurality of crease means formed in said elongated handle portion and said pair of wing portions; said plurality of crease means forming fold lines along which said elongated handle portion and said pair of wing portions are folded so as to form said beverage container holder.

15. The beverage container holder of claim 6, wherein said opening is elliptical in shape when said enlarged head portion is in a flattened position; and said elongated handle portion and said pair of wing portions have tapered side edges so that said elongated handle portion and said pair of wing portions are smaller, as they extend away from said enlarged head portion.

16. The beverage container holder of claim 15, further including a plurality of crease means formed in said elongated handle portion and said pair of wing portions; said plurality of crease means forming fold lines along which said elongated handle portion and said pair of wing portions are folded so as to form said beverage container holder.

17. The beverage container holder of claim 16 wherein said each of said pair of wing portions includes an outer tip, and said outer tip of each of said pair of wing portions are removably secured together to form said beverage container holder.

18. A beverage container holder made from a blank, comprising, in combination:

a body having an enlarged head portion secured to an elongated, tapered carrying portion;

an elliptical opening formed in said enlarged head portion;

a pair of elongated, tapered wing portions secured to said enlarged head portion;

fold lines formed in said elongated, tapered wing portions substantially along a line where each of said elongated, tapered wing portions are secured to said enlarged head portion;

a plurality of crease means formed on said elongated, tapered carrying portion and said pair of elongated, tapered wing portions; said crease means forming further fold lines along which said elongated, tapered carrying portion and said pair of elongated, tapered wing portions may be folded; and each of said pair of elongated, tapered wing portions having an outer tip with securing means securing the respective outer tips together.

* * * * *